US007114973B2

(12) United States Patent
Haggerty

(10) Patent No.: US 7,114,973 B2
(45) Date of Patent: Oct. 3, 2006

(54) CONTACT ARRANGEMENT

(75) Inventor: Alan James Haggerty, Beaminster (GB)

(73) Assignee: Westland Helicopters Limited, Yeovil (GB)

( * ) Notice: Subject to any disclaimer, the term of this patent is extended or adjusted under 35 U.S.C. 154(b) by 0 days.

(21) Appl. No.: 10/958,583

(22) Filed: Oct. 6, 2004

(65) Prior Publication Data

US 2005/0215126 A1 Sep. 29, 2005

(51) Int. Cl.
*H01R 13/64* (2006.01)

(52) U.S. Cl. ..... 439/246

(58) Field of Classification Search ..... 439/246, 439/247, 248, 66, 700, 824; 324/158, 73 PC
See application file for complete search history.

(56) References Cited

U.S. PATENT DOCUMENTS

| | | | | |
|---|---|---|---|---|
| 2,448,962 | A | 9/1948 | D'Ardenne | |
| 2,868,081 | A | 1/1959 | Grover | |
| 4,795,977 | A * | 1/1989 | Frost et al. | 324/537 |
| 5,589,655 | A | 12/1996 | Gaulmier et al. | |
| 5,769,652 | A * | 6/1998 | Wider | 439/248 |
| 5,893,767 | A | 4/1999 | Broschard, III | |
| 6,486,423 | B1 | 11/2002 | Karasik et al. | |
| 6,758,682 | B1 * | 7/2004 | Kosmala | 439/66 |
| 2002/0197891 | A1 | 12/2002 | Suematsu | |
| 2005/0064765 | A1 | 3/2005 | Simpson et al. | |

FOREIGN PATENT DOCUMENTS

| | | |
|---|---|---|
| GB | 2363254 | 12/2001 |

* cited by examiner

*Primary Examiner*—Tulsidas C. Patel
*Assistant Examiner*—Phuongchi Nguyen
(74) *Attorney, Agent, or Firm*—Stites & Harbison PLLC; Douglas E. Jackson

(57) ABSTRACT

A contact arrangement, for enabling an electrical connection to be made between first and second electrodes, in which the first electrode is moveable in a direction along or parallel to an axis into contact with the second electrode, the second electrode including a sharp end formation and being resiliently biased in a direction transverse to the direction of movement of the first electrode, the first electrode including a generally planar surface which extends transversely of the axis and the second electrode is mounted so that when the first and second electrodes are in contact, as the first electrode is continued to be moved along or parallel to the axis, the second electrode moves relative to the first electrode in a direction transverse to the direction of movement of the first electrode across the planar surface of the first electrode.

16 Claims, 2 Drawing Sheets

CONTACT ARRANGEMENT

BACKGROUND TO THE INVENTION

Figure 1A:
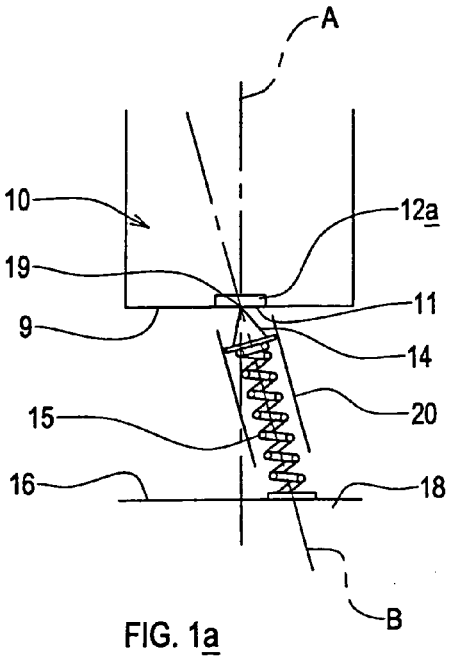

This invention relates to a contact arrangement for enabling an electrical connection between two electrodes. The invention has more particularly but not exclusively been developed for use in enabling an electrical connection to be made between an electrode of a housing and an electrode of an electrically initiated explosive device (EIED), such as for example only, a flare.

DESCRIPTION OF THE PRIOR ART

EIED's typically include an electrical device for detonating an explosive charge when a signal is received. In its simplest form, the electrical device is a resistance wire which is heated when an electrical current passes through it, so as to detonate the explosive charge.

Where the EIED is a flare, typically a plurality of flares may be provided in individual housings of a cassette apparatus carried for example on an aircraft such as a helicopter.

Electrodes of the housings and flares are brought into contact as the flares are loaded into their housings in the cassette, there being a controller to initiate firing of any individual flare in the cassette. Known such arrangements have an unacceptable failure rate, which in many instances is due to poor contact between the respective electrodes of the housings and flares. This may be due to a flare having an insulating layer, such as provided by a protective lacquer coating, or provided due to the formation of an oxidising layer, in each case which prevents sufficiently good contact between the electrode of the housing and the electrode of the flare, for an adequate electrical current or other signal subsequently to pass to the electrical device of the EIED to detonate the explosive charge.

Moreover, the integrity of the resistance wire is sometimes tested when the EIED is loaded, by passing a very low current therethrough. Whereas the current used to detonate the explosive charge may be sufficient to pass a poor electrical connection, a small current used for testing purposes, may well not.

The electrode of the flare typically is moved into contact with an electrode of the housing, as the flare is inserted into its housing along a movement axis, the electrode of the housing being resiliently biased along the movement axis into contact with the electrode of the housing. However, even by providing the housing electrode with a sharp point, this can fail to penetrate any insulating layer.

SUMMARY OF THE INVENTION

According to a first aspect of the invention we provide a contact arrangement, for enabling an electrical connection to be made between first and second electrodes, in which the first electrode is moveable in a direction along or parallel to an axis into contact with the second electrode, the second electrode including a sharp end formation and being resiliently biased in a direction transverse to the direction of movement of the first electrode, the first electrode including a generally planar surface which extends transversely of the axis and the second electrode is mounted so that when the first and second electrodes are in contact, as the first electrode is continued to be moved along or parallel to the axis, the second electrode moves relative to the first electrode in a direction transverse to the direction of movement of the first electrode across the planar surface of the first electrode.

In accordance with the invention, as the second electrode moves transversely of the direction of movement of the first electrode, the sharp formation of the second electrode will tend to scratch any insulating layer on the first electrode so that contact between the electrodes is improved, thus improving electrical connection when electric current passes between the electrodes.

Thus where the invention is applied to EIEDs such as flares, e.g. mounted in a cassette, the failure rate is reduced, and even small electrical currents used for integrity testing, may pass between the electrodes.

The generally planar surface of the first electrode may be provided on an end surface of a device which extends transversely, preferably normal, to the direction of movement of the first contact, with the second electrode mounted between a base of a housing of the device and the end surface of the device. If desired, the device may have a pair of first electrodes, and a pair of second electrodes may be provided each to contact a respective first electrode as the first electrode is moved.

In a first embodiment, the second electrode is carried by a resilient biasing element, such as a spring, which acts along an axis which is transverse to the direction of movement of the first electrode. When the first and second electrodes are in contact, as the first electrode is continued to be moved, the spring may be compressed as the second electrode moves transversely of the direction of movement.

Where the resilient biasing element is a coil spring, which is unstable along its axis, the spring may be provided with a guide which constrains the spring axially to compress, rather than distort about its axis, as the first electrode is continued to be moved.

In a preferred arrangement, the spring or other resilient biasing element acts along an axis which is inclined at an angle between 1° and 60° to the direction of movement of the first electrode, and preferably at an angle of about 2° to 5°.

In another embodiment, the second electrode may be carried by a moveable member which is moveable along an inclined plane in a direction transversely of the direction of movement of the first electrode as the first electrode is continued to be moved after contacting the second electrode, the moveable member being resiliently biased to urge the second electrode along the inclined plane in an opposite direction. The inclined plane may extend at an angle of between 1° and 89° and preferably about 30° to 60° to the direction of movement of the first electrode.

The moveable member may have a base surface lying in a plane extending transversely to the axis of movement, and the housing may include a correspondingly inclined surface, e.g. provided by a mounting, preferably with low friction between the inclined surfaces so that the inclined surface of the moveable member may easily slide relative to inclined surface of the mounting.

The resilient biasing may in the second embodiment, be provided by a coil spring acting in a direction generally normal to the direction of movement of the first electrode.

In yet another embodiment, the second electrode may be mounted on an arm which is pivotable about a pivot axis, pivotal movement of the arm in response to continued movement of the first electrode, being resisted by a resilient biasing element, such as a coil spring, which is wound about the pivot axis.

In each embodiment, the second electrode may have a point to facilitate scratching any insulating layer on the first electrode. For example the second electrode may have a conical or pyramidal configuration, providing the point.

The first electrode may be an electrode of an electrically initiated explosive device, and the second electrode may be provided by a housing for the electrically initiated explosive device.

According to a second aspect of the invention we provide in combination, an electrically initiated explosive device and a housing therefore, with a contact arrangement in accordance with the first aspect of the invention for enabling an electrical connection to be made to the electrically initiated explosive device.

Figure 1B:
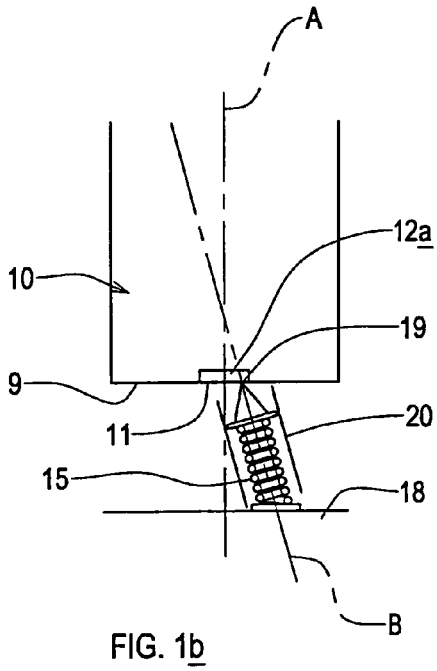
Figure 2A:
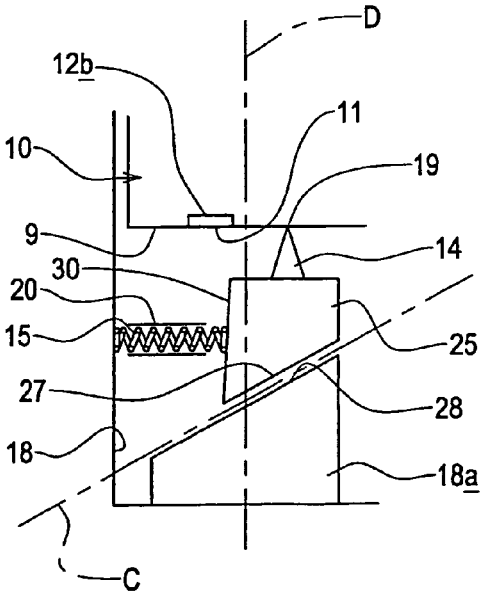
Figure 2B:
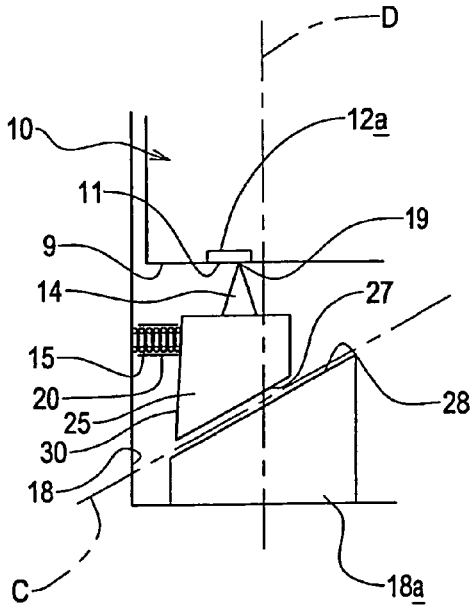
Figure 3:
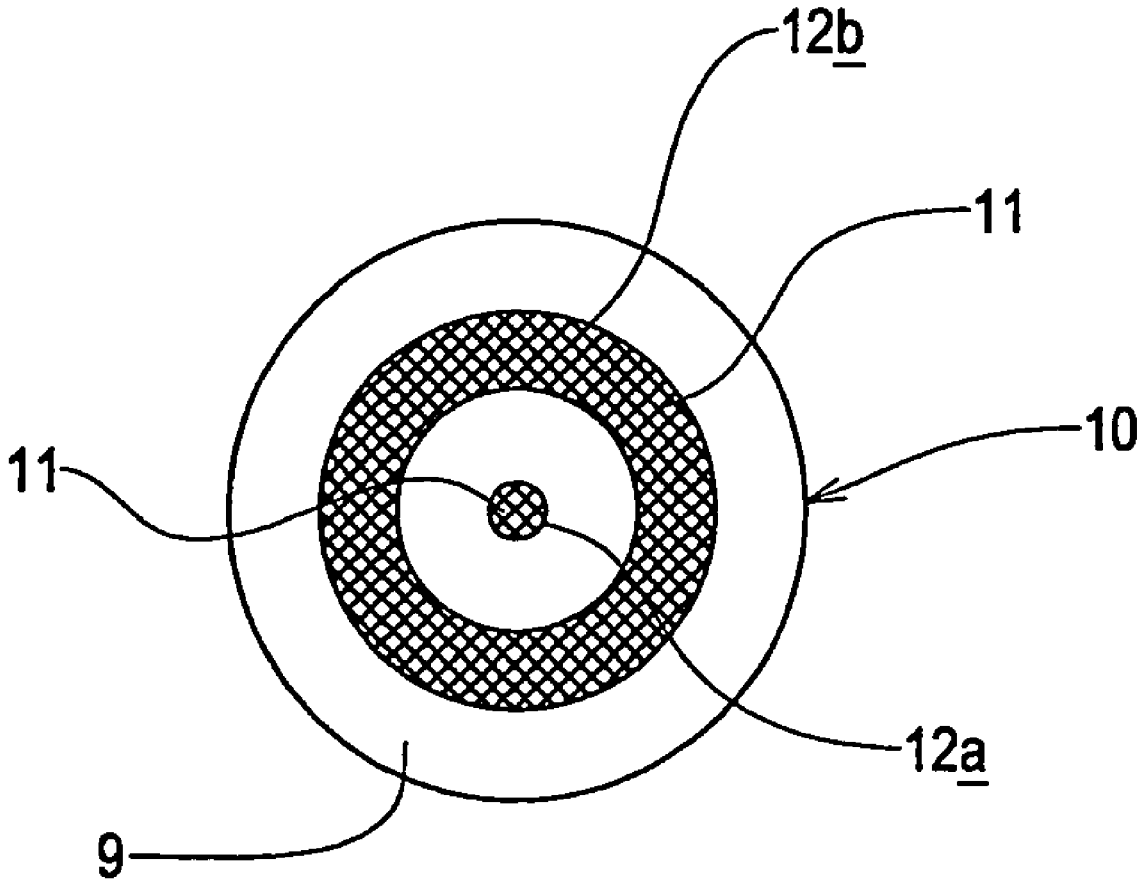

Embodiments of the invention will now be described by way of example, with reference to the accompanying drawings in which:

FIGS. 1*a* and 1*b* are illustrative views of a first embodiment of a contact arrangement in accordance with the invention in alternative conditions;

FIGS. 2*a* and 2*b* are illustrative views of a second embodiment of a contact arrangement in accordance with the invention in alternative conditions, FIG. 3 is an illustrative view of a base of an electrically initiated explosive device to which an electrical connection may be made by a contact arrangement in accordance with the invention.

Referring first to FIG. 3, an electrically initiated explosive device 10 (EIED) is shown which in this example is a flare, which includes an explosive charge which may be detonated when required by an electrical signal which passes to an electrically operated detonator of the device 10 via an electrical connection provided by an electrical contact arrangement of the invention.

Alternatively, a small current may be passed through the electrical connection, insufficient to detonate the explosive, to determine the inventory, e.g. to test the integrity of an electrical resistance wire of the detonator.

In this example the EIED 10 is round in cross section, and on a generally planar end surface 9, there are provided a pair of first electrodes 12*a*, 12*b*, each of which may be contacted by a respective second electrode of a housing which receives the EIED 10. The contacts 12*a*, 12*b* each lie in the plane of the planar end surface 9, and thus each have their own generally planar surfaces 11.

In the example of FIG. 3, one electrode 12*a* is provided at a generally central position of the end surface 9, and the other ring-shaped electrode 12*b* is provided concentrically of the one electrode 12*a*. Thus as the EIED 10 is loaded into the housing 18, the rotational position of the EIED 10 is non-critical.

Typically, the EIED 10 will be loaded into its housing by a purely axial movement in a direction indicated by arrow axis A (see other figures), although, the EIED 10 may be rotated also.

The electrically operated detonator typically includes a resistance wire which becomes heated as an electrical current is passed therethrough, e.g. from electrode 12*a* to electrode 12*b*, thus to detonate the explosive charge, or through which a small electrical current may be passed to test the integrity thereof.

Referring now to FIGS. 1*a* and 1*b*, electrical current may be supplied from any power source, to the EIED 10 via a second electrode 14 provided in a housing 18, which electrode 14 is electrically connected in use, to the power source, via a controller (not shown).

The second electrode 14 is carried on a resilient biasing member 15 which in this example is a coil spring, which is provided on a base 16 of the housing 18 which receives the EIED 10. The second electrode 14 is positioned in use, between the end surface 9 of the EIED 10 and the base 16 of the housing 18.

In FIGS. 1*a* and 1*b* a contact arrangement is shown for enabling an electrical connection between the central first electrode 12*a* of the EIED 10, and the second electrode 14. Thus as the EIED 10 is received by the housing 18, the first contact 12*a* will move along or parallel to the axis A of movement of the EIED 10.

In a typical known contact arrangement, the spring 15 is mounted so as to act axially along the axis of movement A of the EIED 10 as the EIED 10 is received by the housing 18. However in accordance with the present invention, the spring 15 is mounted so as to act along a spring axis B which is transverse to the axis A of movement of the EIED 10 so when the first electrode 12*a* and the second electrode 14 contact, as the EIED 10 is continued to be moved along the axis A of movement, the second contact 14 will be moved transversely across the end surface 9 of the EIED 10 and the surface 11 of the electrode 12*a*, so as to tend to scratch any insulating layer which may be present on the first electrode 12*a*, thus improving contact between the first 12*a* and second 14 electrodes.

To facilitate this, the second electrode 0.14 has a sharp end formation or point 19, provided in the example by the tip of the conical or pyramidal configuration second electrode 14.

The coil spring 15 is mounted on the base 16 of the housing 18 close to but spaced from the axis A of movement of the EIED 10, and acts along the axis B which extends at an angle of between 1° and 89° and preferably at about 2° to 5° to the axis A, for maximum electrode surface 12*a* scratching efficiency. However, as a coil spring 15 may be unstable about its axis B, as show desirably the coil spring 15 is constrained by a guide 20, to act along the spring axis B.

In FIG. 1*a*, the contact arrangement is shown just as the first 12*a* and second 14 electrodes contact as the EIED 10 is moved along axis A to be received by the housing 18. In FIG. 1*b*, the coil spring 15 is shown in a compressed state and it can be seen that the second electrode 14 has been moved transversely across the end surface 9 and the planar surface of the first electrode 12*a*, and this corresponds to where the TIED 10 is in its finally mounted position.

Referring now to FIGS. 2*a* and 2*b* a second embodiment of the invention is shown in which similar parts to those shown in FIGS. 1*a* and 1*b* are labelled by the same references.

In this example a contact arrangement is shown for enabling an electrical connection between the ring-shaped first electrode 12*b* of the EIED 10, and a second electrode 14 of the housing 18. Thus as the EIED 10 is received by the housing 18, the first contact 12*b* will move along or parallel to the axis A.

In FIGS. 2*a* and 2*b*, the second electrode 14 is carried by a mounting member 25 which moves along an inclined plane C when the first and second electrodes 12*a*, 14 are in contact and the EIED 10 is continued to be moved along the axis A.

In FIG. 2*a* a contact arrangement is shown as the EIED 10 is received in the housing 18 and the first and second electrodes 12*b*, 14 contact. In FIG. 2*b* the arrangement is shown, when the EIED has been further moved along the axis of movement A to bring the EIED 10 to its finally mounted position.

It can be seen that the mounting member 25 has a generally planar surface 27 inclined to the axis A of movement of the EIED 10, and a mounting 18*a* of the housing 18, provides a generally planar correspondingly inclined surface 28. The mounting member 25 may thus slide relative to the included surface 28 of the housing 18, along the inclined plane C as the EIED 10 is continued to be moved from the FIG. 2*a* to the FIG. 2*b* position, the second electrode 14 tending to scratch any insulating layer present on the generally planar surface 11 of the first electrode 12*b*, to improve contact.

If required the respective inclined surfaces 27, 28 may be treated to reduce friction and facilitate sliding of the mounting member 25. However, in any event, sliding movement of the mounting member 25 is resisted by a spring 15 which resiliently biases the mounting member "up" the inclined plane C into contact with the end surface 9 of the EIED 10 as the EIED 10 is received in the housing 18. In this example, the spring 15 acts generally normally to the movement axis A of the EIED 10 but may be otherwise transverse to the axis A.

It will be appreciated that the moveable member 25, when moving along the inclined plane C between its FIG. 2*a* and FIG. 2*b* positions, will compress the coil spring 15, and also the spring 15 will need to move relative to a bearing surface 30 of the moveable member 25 on which the spring 15 acts.

Preferably the inclined plane extends at an angle of between 1° and 89° and preferably about 30°–60° to the axis A so that the moveable member 25 relatively easily slides along the inclined surface 28 provided by the housing 18 whilst imparting an adequate force to the second electrode 14 to scratch the surface 11 of the first electrode 12*b* as the EIED 10 is received in the housing 18.

In this second embodiment, the second electrode 14 is conical or pyramidal or otherwise is provided with a sharp end formation or point 19. In another embodiment (not illustrated) the second electrode 14 may be carried on an arm which may be pivotable about a pivot axis inclined to, but preferably normal to, the direction of movement of the first electrode 12*a*, 12*b* as the EIED 10 is loaded into the housing 18. A coil spring wound about the pivot axis, or another resilient biasing element, may resist pivotal movement of the arm as the first electrode 12*a*, 12*b* is continued to be moved beyond the position where the first electrode 12*a*, 12*b* comes into contact with the second contact 14.

Thus the second electrode 14 will be urged into contact with the first electrode 12*a*, 12*b*. By virtue of the arm being pivotal about the inclined pivot axis, as the arm pivots, when the first electrode 12*a*, 12*b* is continued to be moved, the second electrode 14 will tend to scratch any insulating layer on the first electrode 12*a*, 12*b* as there will be a differential movement of the second electrode 14 relative to the first electrode 12*a*, 12*b* in a direction transverse to the direction of continued movement of the first electrode 12*a*, 12*b*. The second electrode 14 may have a sharp point 19 to facilitate this scratching, like the second electrodes 14 described in the reference to the drawings of the previous embodiments.

In each embodiment the housing 18 to receive the EIED may be configured as desired to receive the EIED 10 and hold the EIED in its finally mounted position, provided that the second electrode 14 may be mounted with respect to the housing 18 so as to contact the first electrode 12*a*, 12*b* of the EIED 10 as the EIED is received in the housing. In one arrangement, the housing 18 may have one or more side walls, or may be afforded by one or more retaining arms which at least partially embrace the EIED 10. Other configurations are possible.

The housing 18 may be one of a plurality of housings for EIEDs provided by a cassette, the individual EIEDs being moveable in the cassette to a firing position where the individual EIEDs may be fired under the control of a controller. Such a cassette of EIEDs being flares, may be carried on an aircraft such as a helicopter.

The invention claimed is:

1. A contact arrangement, for enabling an electrical connection to be made between first and second electrodes, in which the first electrode is moveable in a direction along or parallel to an axis into contact with the second electrode, the second electrode including a sharp end and being resiliently biased in a direction transverse to the direction of movement of the first electrode, the first electrode including a generally planar surface which extends transversely of the axis and which engages the sharp end of the second electrode when the electrodes are in contact, the second electrode being mounted so that when the first electrode and the sharp end of the second electrodes are in contact, as the first electrode is continued to be moved along or parallel to the axis, the sharp end of the second electrode moves relative to the first electrode in a direction transverse to the direction of movement of the first electrode across and in contact with the planar surface of the first electrode.

2. A contact arrangement according to claim 1 wherein the first electrode has thereon an insulating layer and as the second electrode moves transversely of the direction of movement of the first electrode, the sharp end of the second electrode scratches the insulating layer so that contact between the electrodes is improved, to improve electrical connection when electric current passes between the electrodes.

3. A contact arrangement according to claim 1 wherein the first electrode is an electrode of an electrically initiated explosive device, and the second electrode is provided by a housing for the electrically initiated explosive device.

4. A contact arrangement according to claim 1 wherein the generally planar surface of the first electrode is provided on an end surface of a device and the second electrode mounted between a base of a housing of the device and the end surface of the device.

5. A contact arrangement according to claim 4 wherein the device has a pair of first electrodes, and a pair of second electrodes are provided each to contact a respective first electrode as the device is moved.

6. A contact arrangement according to claim 1 wherein the second electrode is carried by a moveable member which is moveable along an inclined plane in a direction transversely of the direction of movement of the first electrode as the first electrode is continued to be moved after contacting the second electrode, the moveable member being resiliently biased to urge the second electrode along the inclined plane in an opposite direction.

7. A contact arrangement according to claim 6 wherein the moveable member has a surface lying in a plane extending transversely to the axis of movement, and the housing includes a correspondingly inclined surface.

8. A contact arrangement according to claim 6 wherein the resilient biasing element is provided by a coil spring acting in a direction generally normal to the direction of movement of the first electrode.

9. A contact arrangement according to claim 6 wherein the inclined plane extends at an angle of between 1° and 89° to the direction of movement of the first electrode.

10. A contact arrangement according to claim 9 wherein the inclined plane extends at an angle of about 30° to 60° to the direction of movement of the first electrode.

11. A contact arrangement according to claim 1 wherein the second electrode is carried by a resilient biasing element, which acts primarily along an axis which is transverse to the direction of movement of the first electrode.

12. A contact arrangement according to claim 11 wherein the resilient biasing element is a spring which, when the first and second electrodes are in contact, as the first electrode is continued to be moved, is compressed as the second electrode moves transversely of the direction of movement.

13. A contact arrangement according to claim 12 wherein the spring is provided with a guide which constrains the spring to compress axially, and restrains distortion about its axis, as the first electrode is continued to be moved.

14. A contact arrangement according to claim 11 wherein the axis along which the resilient biasing element primarily acts is inclined at between 1° and 60° to the direction of movement of the first electrode.

15. A contact arrangement according to claim 14 wherein the axis along which the resilient biasing element primarily acts, is at an angle of about 2° to 5° to the direction of movement of the first electrode.

16. In combination, an electrically initiated explosive device and a housing therefore, with a contact arrangement for enabling an electrical connection to be made to the electrically initiated explosive device, the contact arrangement enabling an electrical connection to be made between first and second electrodes, in which the first electrode is moveable in a direction along or parallel to an axis into contact with the second electrode, the second electrode including a sharp end and being resiliently biased in a direction transverse to the direction of movement of the first electrode, the first electrode including a generally planar surface which extends transversely of the axis and which engages the sharp end of the second electrode when the electrodes are in contact, the second electrode being mounted so that when the first electrode and the sharp end of the second electrodes are in contact, as the first electrode is continued to be moved along or parallel to the axis, the sharp end of the second electrode moves relative to the first electrode in a direction transverse to the direction of movement of the first electrode across and in contact with the planar surface of the first electrode.

* * * * *